US011220773B2

(12) United States Patent
Ashrafzadeh et al.

(10) Patent No.: US 11,220,773 B2
(45) Date of Patent: Jan. 11, 2022

(54) LAUNDRY TREATING APPLIANCE AND METHOD OF OPERATION FOR A LAUNDRY TREATING APPLIANCE

(71) Applicant: WHIRLPOOL CORPORATION, Benton Harbor, MI (US)

(72) Inventors: Farhad Ashrafzadeh, Bowling Green, KY (US); Claudio Civanelli, Travedona Monate (IT); Sarah E. Ihne, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 452 days.

(21) Appl. No.: 16/356,653

(22) Filed: Mar. 18, 2019

(65) Prior Publication Data

US 2019/0211490 A1 Jul. 11, 2019

Related U.S. Application Data

(62) Division of application No. 13/936,488, filed on Jul. 8, 2013, now Pat. No. 10,273,619.

(51) Int. Cl.

| | |
|---|---|
| ***D06F 33/37*** | (2020.01) |
| *D06F 103/18* | (2020.01) |
| *D06F 105/42* | (2020.01) |
| *D06F 105/58* | (2020.01) |
| *D06F 105/60* | (2020.01) |
| *D06F 34/32* | (2020.01) |

(52) U.S. Cl.

CPC ..... *D06F 33/37* (2020.02); *D06F 34/32* (2020.02); *D06F 2103/18* (2020.02); *D06F 2105/42* (2020.02); *D06F 2105/58* (2020.02); *D06F 2105/60* (2020.02)

(58) Field of Classification Search

CPC .. D06F 33/37; D06F 2105/42; D06F 2105/60; D06F 2103/18; D06F 34/32; D06F 2105/58; D06F 39/004; D06F 33/02; D06F 39/02; D06F 39/005; A47L 15/4297

USPC ..... 8/137, 158, 159; 68/12.02, 12.27, 12.12, 68/12.07, 3 R

See application file for complete search history.

(56) References Cited

U.S. PATENT DOCUMENTS

| | | | | |
|---|---|---|---|---|
| 4,406,028 A * | 9/1983 | Hazan | D06F 34/22 | 8/158 |
| 4,763,493 A * | 8/1988 | Nishite | D06F 34/32 | 68/12.27 |
| 6,169,964 B1 * | 1/2001 | Aisa | D06F 34/28 | 702/136 |

(Continued)

FOREIGN PATENT DOCUMENTS

| | | |
|---|---|---|
| CH | 704722 A2 | 8/2012 |
| FR | 2898609 B1 | 5/2008 |

*Primary Examiner* — David G Cormier
*Assistant Examiner* — Thomas Bucci
(74) *Attorney, Agent, or Firm* — McGarry Bair PC

(57) ABSTRACT

A laundry treating appliance and a method operating a laundry treating appliance having a dye sensor configured to output a signal indicative of the amount of dye within liquid in the treating chamber, a controller having a memory in which is stored a set of executable instructions including at least one user-selectable cycle of operation, and a user interface operably coupled with the controller and providing an input and output function for the controller and provide information related to a dye release.

20 Claims, 5 Drawing Sheets

(56) References Cited

U.S. PATENT DOCUMENTS 7,113,280 B2 * 9/2006 Oon ..... G01N 21/31 356/406
7,400,407 B2 7/2008 Ng et al.
8,108,063 B2 * 1/2012 Agrawal ..... D06F 34/22 700/143
2002/0078511 A1 * 6/2002 Blair ..... D06F 34/32 8/159
2003/0024055 A1 * 2/2003 Broker ..... D06F 39/06 8/158
2003/0025733 A1 * 2/2003 Broker ..... G06F 3/0482 715/765
2003/0154560 A1 * 8/2003 Behrens ..... D06F 34/28 8/159
2004/0095370 A1 * 5/2004 Broker ..... D06F 34/32 715/705
2004/0156170 A1 * 8/2004 Mager ..... G09F 9/372 361/679.01
2005/0016228 A1 * 1/2005 Bergemann ..... D06F 34/32 68/12.12
2006/0007444 A1 * 1/2006 Oon ..... G01N 21/05 356/406
2007/0028397 A1 * 2/2007 Park ..... D06F 33/37 8/158
2007/0169281 A1 * 7/2007 Ha ..... D06F 34/28 8/158
2007/0299545 A1 * 12/2007 Agrawal ..... D06F 34/22 700/12
2008/0003904 A1 * 1/2008 Agrawal ..... D06F 35/006 442/121
2008/0276966 A1 * 11/2008 Yusuf ..... D06F 33/36 134/18
2008/0314423 A1 * 12/2008 Berends ..... A47L 15/4293 134/57 D
2009/0007346 A1 * 1/2009 Ha ..... D06F 33/34 8/159
2009/0121970 A1 * 5/2009 Ozbek ..... F24C 7/082 345/4
2011/0308023 A1 * 12/2011 Park ..... D06F 35/005 8/137
2012/0036900 A1 * 2/2012 Hong ..... D06F 34/32 68/139
2012/0056827 A1 * 3/2012 Kim ..... D06F 34/32 345/173
2012/0180227 A1 * 7/2012 Kim ..... D06F 33/46 8/137
2012/0209444 A1 * 8/2012 Seo ..... D06F 34/28 700/295
2012/0330442 A1 * 12/2012 Hwang ..... D06F 33/30 700/90
2013/0290902 A1 * 10/2013 Martin ..... G06F 3/0485 715/823
2013/0321136 A1 * 12/2013 Park ..... G08C 17/02 340/12.54
2014/0018962 A1 * 1/2014 Jung ..... D06F 34/28 700/275
2014/0156082 A1 * 6/2014 Ha ..... H04L 12/2818 700/275
2014/0259441 A1 * 9/2014 Fulmer ..... D06M 13/395 8/137
2014/0259446 A1 * 9/2014 Ghosh ..... D06M 13/395 8/137
2014/0259447 A1 * 9/2014 Alexander ..... C11D 3/0021 8/137
2014/0259448 A1 * 9/2014 Alexander ..... D06F 35/005 8/137
2014/0277751 A1 * 9/2014 Fulmer ..... C11D 1/835 700/275
2015/0345068 A1 * 12/2015 Coffman ..... G06F 3/04817 715/771

* cited by examiner

LAUNDRY TREATING APPLIANCE AND METHOD OF OPERATION FOR A LAUNDRY TREATING APPLIANCE

CROSS-REFERENCE TO RELATED APPLICATIONS

This application is a divisional application of U.S. patent application Ser. No. 13/936,488, filed Jul. 8, 2013, now U.S. Pat. No. 10,273,619, issued Apr. 30, 2019, which is incorporated herein by reference in its entirety.

BACKGROUND

Laundry treating appliances, such as clothes washers, clothes dryers, refreshers, and non-aqueous systems, may have a configuration based on a rotating drum that defines a treating chamber in which laundry items are placed for treating according to one or more cycles of operation. The laundry treating appliance may have a controller that implements the cycles of operation. The controller may control a user interface to communicate with a user.

BRIEF DESCRIPTION

In one aspect, the invention relates to a method of operating a laundry treating appliance having a treating chamber for receiving laundry for treatment according to an automatic cycle of operation implemented by a controller of the laundry treating appliance and having a user interface for communication with a user of the appliance, the method comprising determining a dye has been released from the laundry within the treating chamber to define a determined dye release, and indicating, on the user interface, information related to the dye release based on the determined dye release, where the information is separate from an alert that the released dye has been determined, and where the information comprises educational information to prevent future dye release or information regarding at least one consequence of at least one action taken by the laundry treating appliance including at least one of: that the treating cycle of operation used more water, that the treating cycle of operation was less energy efficient, that the treating cycle of operation time will be longer, or that there was reduced performance during the treating cycle of operation.

In another aspect, the invention relates to a method of operating a laundry treating appliance, the method comprising sensing a dye has been released from laundry within a treating chamber by sensing a released dye in liquid in the treating chamber or liquid from the treating chamber, and indicating, on the user interface, information related to the released dye based on the determined dye condition, where the information is separate from an alert that the released dye has been determined, and where the information comprises at least one consequence of at least one action taken by the laundry treating appliance including at least one of: that the treating cycle of operation used more water, that the treating cycle of operation was less energy efficient, that the treating cycle of operation time will be longer, that there was reduced performance during the treating cycle of operation, or educational information to prevent future dye releases including at least one of: information on proper laundry article separation, information related to label care information, color catcher information, or information on selection of a cycle parameter to reduce dye release.

In yet another aspect, the invention relates to a method of operating a laundry treating appliance having a treating chamber for receiving laundry for treatment according to an automatic cycle of operation implemented by a controller of the laundry treating appliance and having a user interface for communication with a user of the appliance, the method comprising sensing, via a sensor, an amount of dye release, comparing the amount of dye release to a predetermined amount threshold, determining, via the controller, based on the comparing that a dye has been released from the laundry within the treating chamber to define a determined dye condition, and indicating, on the user interface, information related to the dye release based on the determined dye condition, where the information is separate from an alert that the released dye has been determined, and where the information comprises educational information to prevent future dye releases including at least one of: information on proper laundry article separation, information related to label care information, color catcher information, or information on selection of a cycle parameter to reduce dye release.

DETAILED DESCRIPTION

Figure 1:
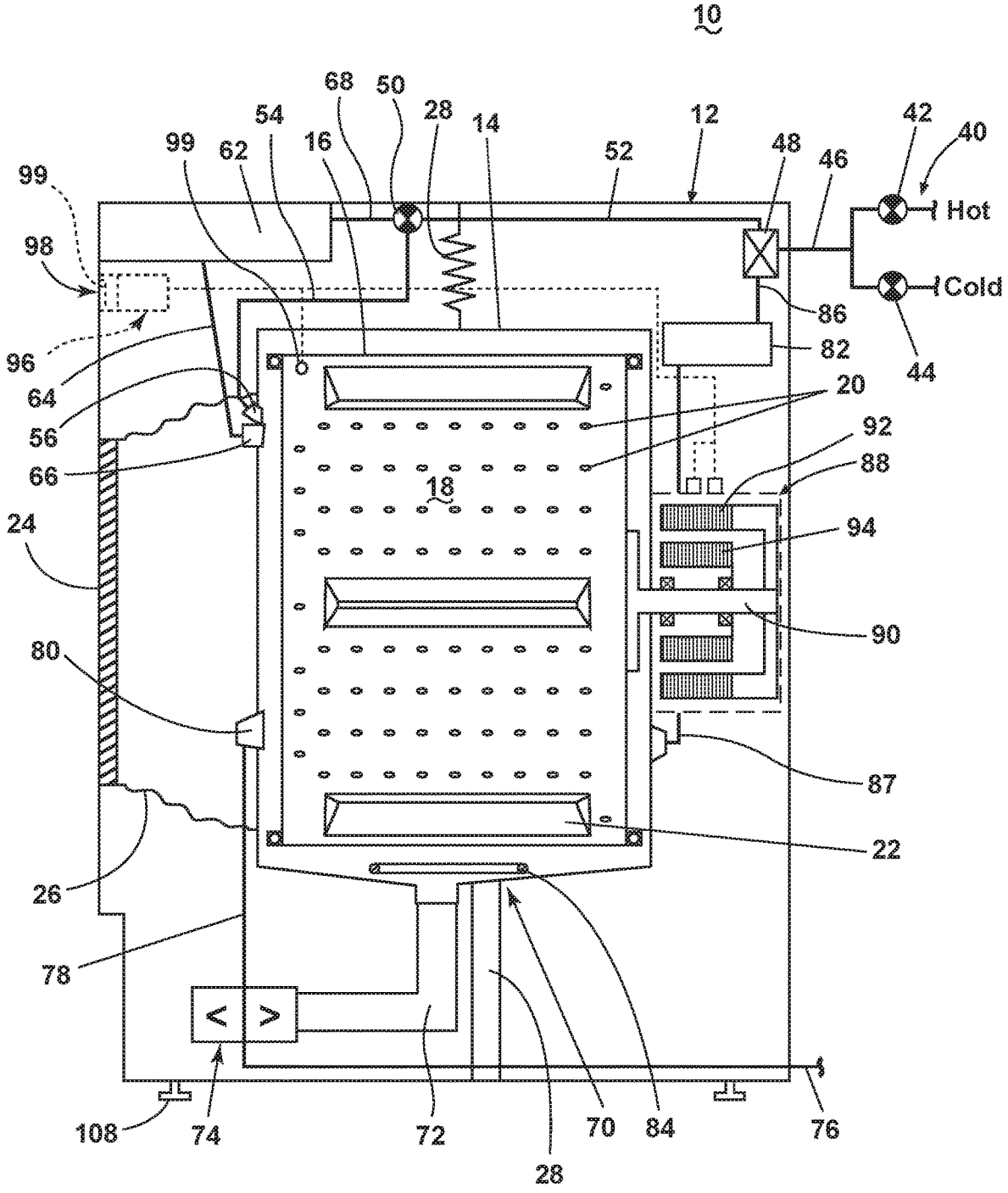
FIG. 1 is a schematic view of a laundry treating appliance in the form of a washing machine according to a first embodiment of the invention.

FIG. 1 is a schematic view of a laundry treating appliance according to a first embodiment of the invention. The laundry treating appliance may be any appliance which performs a cycle of operation to clean or otherwise treat items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine.

As used herein, the term "vertical-axis" washing machine refers to a washing machine having a rotatable drum that rotates about a generally vertical axis relative to a surface that supports the washing machine. However, the rotational axis need not be perfectly vertical to the surface. The drum may rotate about an axis inclined relative to the vertical axis, with fifteen degrees of inclination being one example of the inclination. Similar to the vertical axis washing machine, the term "horizontal-axis" washing machine refers to a washing machine having a rotatable drum that rotates about a generally horizontal axis relative to a surface that supports the washing machine. The drum may rotate about the axis inclined relative to the horizontal axis, with fifteen degrees of inclination being one example of the inclination.

The laundry treating appliance of FIG. 1 is illustrated as a horizontal-axis washing machine 10, which may include a structural support system including a cabinet 12, which defines a housing within which a laundry holding system resides. The cabinet 12 may be a housing having a chassis and/or a frame, defining an interior enclosing components typically found in a conventional washing machine, such as motors, pumps, fluid lines, controls, sensors, transducers, and the like. Such components will not be described further herein except as necessary for a complete understanding of the invention.

The laundry holding system includes a tub 14 supported within the cabinet 12 by a suitable suspension system and a drum 16 provided within the tub 14, the drum 16 defining at least a portion of a laundry treating chamber 18 for receiving a laundry load for treatment. The drum 16 may include a plurality of perforations 20 such that liquid may flow between the tub 14 and the drum 16 through the perforations 20. A plurality of baffles 22 may be disposed on an inner surface of the drum 16 to lift the laundry load received in the treating chamber 18 while the drum 16 rotates. It may also be within the scope of the invention for the laundry holding system to include only a tub with the tub defining the laundry treating chamber.

The laundry treating chamber 18 may have an open face that may be selectively closed by a door 24. More specifically, the door 24 may be movably mounted to the cabinet 12 to selectively close both the tub 14 and the drum 16. A bellows 26 may couple an open face of the tub 14 with the cabinet 12, with the door 24 sealing against the bellows 26 when the door 24 closes the tub 14.

The washing machine 10 may further include a suspension system 28 for dynamically suspending the laundry holding system within the structural support system.

The washing machine 10 may also include at least one balance ring 38 containing a balancing material moveable within the balance ring 38 to counterbalance an imbalance that may be caused by laundry in the treating chamber 18 during rotation of the drum 16. More specifically, the balance ring 38 may be coupled with the rotating drum 16 and configured to compensate for a dynamic imbalance during rotation of the rotatable drum 16. The balance ring 38 may extend circumferentially around a periphery of the drum 16 and may be located at any desired location along an axis of rotation of the drum 16. When multiple balance rings 38 are present, they may be equally spaced along the axis of rotation of the drum 16. For example, in the illustrated example a plurality of balance rings 38 are included in the washing machine 10 and the plurality of balance rings 38 are operably coupled with opposite ends of the rotatable drum 16.

The washing machine 10 may further include a liquid supply system for supplying water to the washing machine 10 for use in treating laundry during a cycle of operation. The liquid supply system may include a source of water, such as a household water supply 40, which may include separate valves 42 and 44 for controlling the flow of hot and cold water, respectively. Water may be supplied through an inlet conduit 46 directly to the tub 14 by controlling first and second diverter mechanisms 48 and 50, respectively. The diverter mechanisms 48, 50 may be a diverter valve having two outlets such that the diverter mechanisms 48, 50 may selectively direct a flow of liquid to one or both of two flow paths. Water from the household water supply 40 may flow through the inlet conduit 46 to the first diverter mechanism 48 which may direct the flow of liquid to a supply conduit 52. The second diverter mechanism 50 on the supply conduit 52 may direct the flow of liquid to a tub outlet conduit 54 which may be provided with a spray nozzle 56 configured to spray the flow of liquid into the tub 14. In this manner, water from the household water supply 40 may be supplied directly to the tub 14.

The washing machine 10 may also be provided with a dispensing system for dispensing treating chemistry to the treating chamber 18 for use in treating the laundry according to a cycle of operation. The dispensing system may include a dispenser 62 which may be a single use dispenser, a bulk dispenser or a combination of a single use and bulk dispenser.

Regardless of the type of dispenser used, the dispenser 62 may be configured to dispense a treating chemistry directly to the tub 14 or mixed with water from the liquid supply system through a dispensing outlet conduit 64. The dispensing outlet conduit 64 may include a dispensing nozzle 66 configured to dispense the treating chemistry into the tub 14 in a desired pattern and under a desired amount of pressure. For example, the dispensing nozzle 66 may be configured to dispense a flow or stream of treating chemistry into the tub 14 by gravity, i.e. a non-pressurized stream. Water may be supplied to the dispenser 62 from the supply conduit 52 by directing the diverter mechanism 50 to direct the flow of water to a dispensing supply conduit 68.

Non-limiting examples of treating chemistries that may be dispensed by the dispensing system during a cycle of operation include one or more of the following: water, enzymes, fragrances, stiffness/sizing agents, wrinkle releasers/reducers, softeners, antistatic or electrostatic agents, stain repellants, water repellants, energy reduction/extraction aids, antibacterial agents, medicinal agents, vitamins, moisturizers, shrinkage inhibitors, and color fidelity agents, and combinations thereof.

The washing machine 10 may also include a recirculation and drain system for recirculating liquid within the laundry holding system and draining liquid from the washing machine 10. Liquid supplied to the tub 14 through tub outlet conduit 54 and/or the dispensing supply conduit 68 typically enters a space between the tub 14 and the drum 16 and may flow by gravity to a sump 70 formed in part by a lower portion of the tub 14. The sump 70 may also be formed by a sump conduit 72 that may fluidly couple the lower portion of the tub 14 to a pump 74. The pump 74 may direct liquid to a drain conduit 76, which may drain the liquid from the washing machine 10, or to a recirculation conduit 78, which may terminate at a recirculation inlet 80. The recirculation inlet 80 may direct the liquid from the recirculation conduit 78 into the drum 16. The recirculation inlet 80 may introduce the liquid into the drum 16 in any suitable manner, such as by spraying, dripping, or providing a steady flow of liquid. In this manner, liquid provided to the tub 14, with or without treating chemistry may be recirculated into the treating chamber 18 for treating the laundry within.

The liquid supply and/or recirculation and drain system may be provided with a heating system which may include one or more devices for heating laundry and/or liquid supplied to the tub 14, such as a steam generator 82 and/or a sump heater 84. Liquid from the household water supply 40 may be provided to the steam generator 82 through the inlet conduit 46 by controlling the first diverter mechanism 48 to direct the flow of liquid to a steam supply conduit 86. Steam generated by the steam generator 82 may be supplied to the tub 14 through a steam outlet conduit 87. The steam generator 82 may be any suitable type of steam generator such as a flow through steam generator or a tank-type steam generator. Alternatively, the sump heater 84 may be used to generate steam in place of or in addition to the steam generator 82. In addition or alternatively to generating steam, the steam generator 82 and/or sump heater 84 may be used to heat the laundry and/or liquid within the tub 14 as part of a cycle of operation.

Additionally, the liquid supply and recirculation and drain system may differ from the configuration shown in FIG. 1, such as by inclusion of other valves, conduits, treating chemistry dispensers, sensors, such as water level sensors and temperature sensors, and the like, to control the flow of liquid through the washing machine 10 and for the introduction of more than one type of treating chemistry.

The washing machine 10 also includes a drive system for rotating the drum 16 within the tub 14. The drive system may include a motor 88 for rotationally driving the drum 16. The motor 88 may be directly coupled with the drum 16 through a drive shaft 90 to rotate the drum 16 about a rotational axis during a cycle of operation. The motor 88 may be a brushless permanent magnet (BPM) motor having a stator 92 and a rotor 94. Alternately, the motor 88 may be coupled with the drum 16 through a belt and a drive shaft to rotate the drum 16, as may be known in the art. Other motors, such as an induction motor or a permanent split capacitor (PSC) motor, may also be used. The motor 88 may rotationally drive the drum 16 including that the motor 88 may rotate the drum 16 at various speeds in either rotational direction.

The control system may control the operation of the washing machine 10 to implement one or more cycles of operation. The control system may include a controller 96 located within the cabinet 12 and a user interface 98 that may be operably coupled with the controller 96. The user interface 98 may provide an input and output function for the controller. The user interface 98 may include one or more knobs, dials, switches, displays 99, touch screens, and the like for communicating with the user, such as to receive input and provide output. For example, the displays may include any suitable communication technology including that of an LCD display, an LED array, or any suitable display that may convey a message to the user. The user may enter different types of information including, without limitation, cycle selection and cycle parameters, such as cycle options. Other communications paths and methods may also be included in the washing machine 10 and may allow the controller 96 to communicate with the user in a variety of ways. For example, the controller 96 may be configured to send a text message to the user, send an electronic mail to the user, or provide audio information to the user either through the washing machine 10 or utilizing another device such as a mobile phone.

The controller 96 may include the machine controller and any additional controllers provided for controlling any of the components of the washing machine 10. For example, the controller 96 may include the machine controller and a motor controller. Many known types of controllers may be used for the controller 96. The specific type of controller is not germane to the invention. It may be contemplated that the controller may be a microprocessor-based controller that implements control software and sends/receives one or more electrical signals to/from each of the various working components to effect the control software. As an example, proportional control (P), proportional integral control (PI), and proportional derivative control (PD), or a combination thereof, a proportional integral derivative control (PID control), may be used to control the various components.

Figure 2:
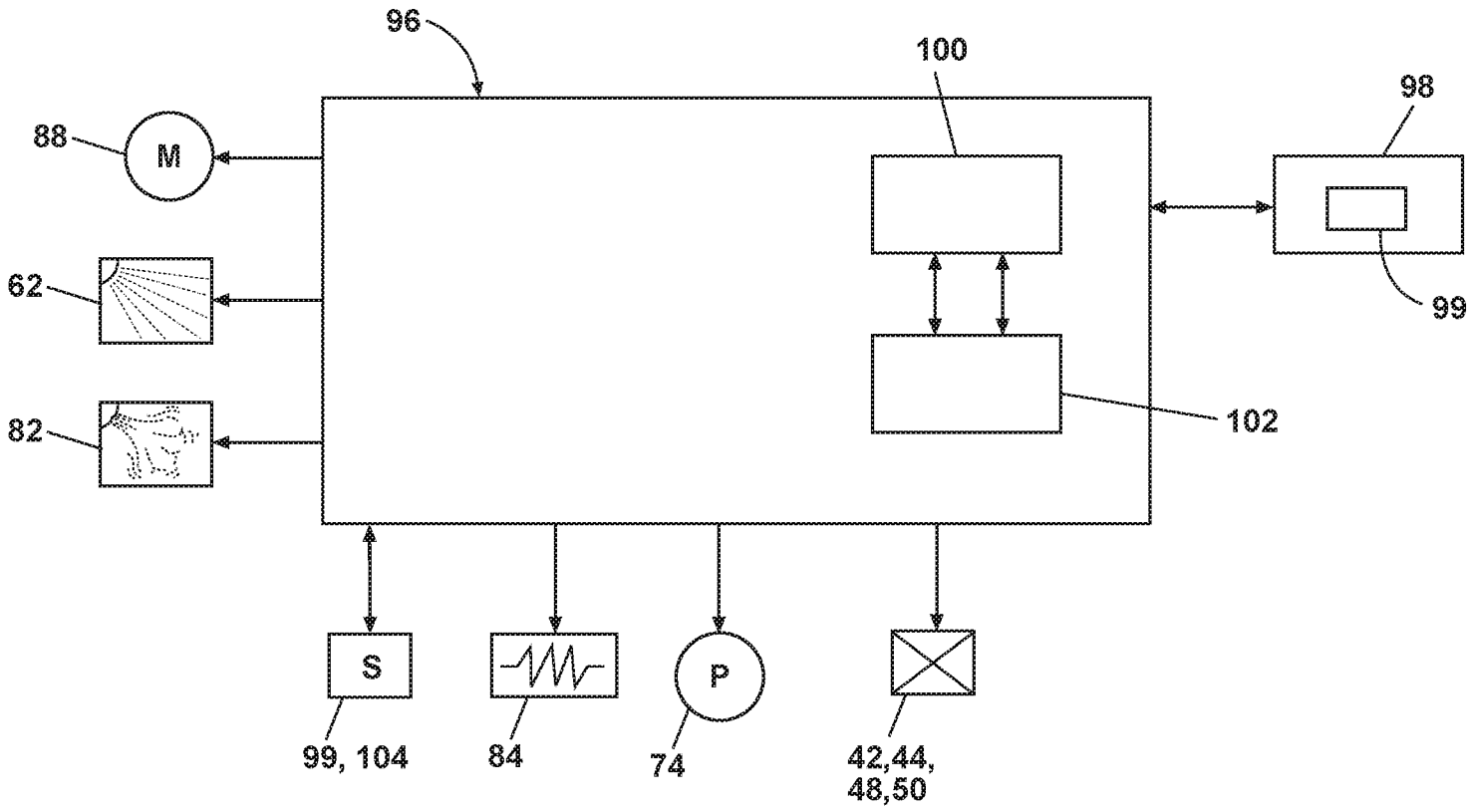
FIG. 2 is a schematic of a control system of the laundry treating appliance of FIG. 1 according to the first embodiment of the invention.

As illustrated in FIG. 2, the controller 96 may be provided with a memory 100 and a central processing unit (CPU) 102. The memory 100 may be used for storing the control software that may be executed by the CPU 102 in completing a cycle of operation using the washing machine 10 and any additional software. For example, the memory 100 may store a set of executable instructions including at least one user-selectable cycle of operation. Examples, without limitation, of cycles of operation include: wash, heavy duty wash, delicate wash, quick wash, pre-wash, refresh, rinse only, and timed wash. The memory 100 may also be used to store information, such as a database or table, and to store data received from one or more components of the washing machine 10 that may be communicably coupled with the controller 96. The database or table may be used to store the various operating parameters for the one or more cycles of operation, including factory default values for the operating parameters and any adjustments to them by the control system or by user input. For example, a table of a plurality of threshold values 120 may be included.

The controller 96 may be operably coupled with one or more components of the washing machine 10 for communicating with and controlling the operation of the component to complete a cycle of operation. For example, the controller 96 may be operably coupled with the motor 88, the pump 74, the dispenser 62, the steam generator 82 and the sump heater 84 to control the operation of these and other components to implement one or more of the cycles of operation.

The controller 96 may also be coupled with one or more sensors 104 provided in one or more of the systems of the washing machine 10 to receive input from the sensors, which are known in the art and not shown for simplicity. Non-limiting examples of sensors 104 that may be communicably coupled with the controller 96 include: a treating chamber temperature sensor, a moisture sensor, a weight sensor, a chemical sensor, a position sensor, an imbalance sensor, a load size sensor, and a motor torque sensor, which may be used to determine a variety of system and laundry characteristics, such as laundry load inertia or mass.

By way of further example, a dye sensor 106 may be included and operably coupled with the controller 96. The dye sensor 106 may be configured to output a signal indicative of the amount of dye within liquid in the treating chamber 18. The dye sensor 106 may be located in any suitable location including within the treating chamber 18 or fluidly coupled with the treating chamber 18, such as in a sump 72 or recirculation conduit 78. The dye sensor 106 may be any suitable sensor or any suitable sensor system for determining an amount of dye in the treating liquid, non-limiting examples of which include a turbidity sensor, a reflection device, a colorimeter, a photo-spectrometer-related sensor, a pH sensor, a conductivity sensor, an optical sensor system which may be used to perform UV/Vis absorbance/fluorescence spectroscopy, etc. For example, a UV/Vis absorbance/fluorescence system may provide an output representative of a sensed spectral absorbance and/or fluorescence of the treating liquid. It will also be understood that when referring to absorbance herein, transmittance, which may be related to absorbance, may be used as an alternative to absorbance or in order to determine the absorbance.

The dye sensor 106 may output a signal indicative of a presence of dye, including an amount of dye, in the liquid within the treating chamber 18. The dye sensor 106 may sense the dye and output the signal continuously or intermittently throughout the cycle of operation or at one or more predetermined stages of the cycle of operation. The controller 96 may receive the output signal indicative of the presence of a dye from the dye sensor 106 and determine whether the output signal satisfies a predetermined threshold to define a dye release event.

For example, the controller 96 may receive the output from the dye sensor 106 and may compare it with an amount threshold stored in the memory 100 to determine when the amount of the dye satisfies the amount threshold. This may include comparing the output to a predetermined reference value that may be a range of reference values, an upper threshold or a lower threshold. The term "satisfies" the threshold is used herein to mean that the variation satisfies the predetermined threshold, such as being equal to, less than, or greater than the threshold value. It will be understood that such a determination may easily be altered to be satisfied by a positive/negative comparison or a true/false comparison. For example, a less than threshold value may easily be satisfied by applying a greater than test when the data may be numerically inverted.

The controller 96 may then correspondingly activate an output on the user interface 98 so that the user interface 98 provides information related to the dye release based on the determined dye release. The information may include at least one of: at least one action taken by the laundry treating appliance in response to the determined dye release, at least one consequence of the at least one action taken by the laundry treating appliance, or educational information to prevent future dye releases. For example, the controller 96 may be configured to alter the cycle of operation to reduce an amount of dye color in the treating liquid and the information may relay to the user the changes made to the washing process.

By way of further example, if the user interface 98 includes an LCD, the LCD may provide the user with multiple screens of information related to information indicating actions taken by the laundry treating appliance, information indicating consequences of actions taken by the laundry treating appliance, or educational information to prevent future dye release events. The controller 96 may also activate an audible alert that the released dye has been determined. The controller 96 may also send a text message to the user, send an electronic mail to the user, or provide audio information to the user either alerting the user that the dye has been determined or to provide additional information to the user.

Figure 3:
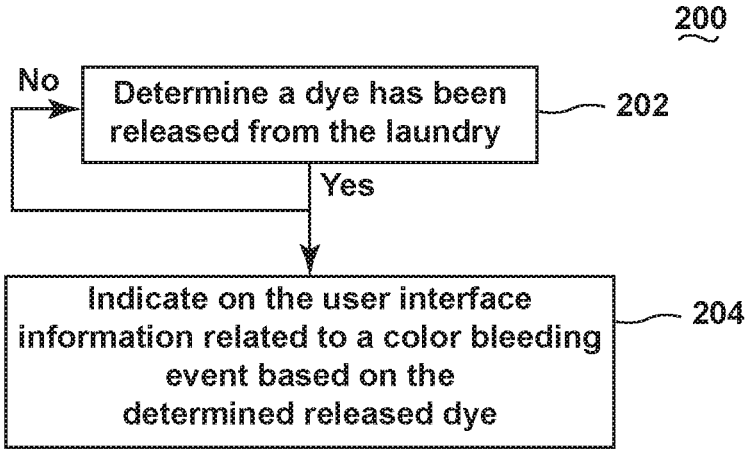
FIG. 3 illustrates a flow chart of a method for operating a laundry treating appliance, such as the washing machines of FIG. 1.

Referring now to FIG. 3, a flow chart of a method 200 for operating a laundry treating appliance, such as the washing machine 10, is illustrated. The sequence of steps depicted for this method is for illustrative purposes only, and is not meant to limit the method in any way as it is understood that the steps may proceed in a different logical order or additional or intervening steps may be included without detracting from the invention. The method 200 may be implemented in any suitable manner, such as automatically or manually, as a stand-alone phase or cycle of operation or as a phase of an operation cycle of the washing machine 10. The method 200 assumes that a user has placed a laundry load within the treating chamber 18 and selected a cycle of operation for the washing machine 10.

The method 200 may begin at 202, where it may be determined that a dye has been released from the laundry within the treating chamber 18. For example, determining the dye release may include sensing a released dye within the treating chamber 18, such as through use of the dye sensor 106. Sensing the released dye may include sensing an amount of dye color in liquid within the treating chamber. A dye release event may be determined by the controller 96 when the amount of sensed dye color satisfies a threshold. It may alternatively be contemplated that the dye sensor 106 may be located exteriorly of the treating chamber 18 but may be fluidly coupled with the treating chamber 18 such that the dye sensor may sense a released dye in liquid from the treating chamber. The determination step may be repeated multiple times until the output of the dye sensor 106 indicates that the amount of dye in the treating liquid satisfies a predetermined threshold and the controller 96 may determine a dye release event.

If the output signal does satisfy the threshold, the controller 96 may determine that dye may be present in the treating liquid. It will be understood that a dye release event may be determined before the dye has transferred to another article in the laundry load or before such a transfer may be perceivable by a user. More specifically, the dye sensor 106 may be sensitive enough to detect the dye(s) in the treating liquid when the concentration may not be enough to cause a visible change in other items in the laundry load.

Once it has been determined that dye has been released from the laundry in the treating chamber 18 the controller 96 may indicate, on the user interface 98, information related to the dye release. The information may include at least one of: at least one action taken by the laundry treating appliance in response to the determined dye release, at least one consequence of the at least one action taken by the laundry treating appliance, or educational information to prevent future dye releases. The information may be provided to the user through text or audio communicated through the user interface 98.

Optionally, the determination of the dye release may be used to modify the cycle of operation. For example, the controller 96 may use the output to determine an amount of dye present in the treating liquid and take at least one action to alter the cycle of operation to reduce the amount of dye color in treating liquid. For example, the controller 96 may alter the cycle of operation by draining the treating liquid and may repeat the wash or rinse phase of the cycle of operation. The controller 96 may also modify cycle parameters such as temperature of the treating liquid, pH of the treating liquid, and/or an amount of a treating agent to add. The controller 96 may also stop the cycle of operation so that no visible dye transfer takes place. The information indicated on the user interface at 204 may include information indicating actions taken by the laundry treating appliance includes information regarding the altering of the cycle of operation. For example, the user interface 98 may indicate information including at least one of: that liquid was drained from the treating chamber 18, that the cycle of operation was stopped, that a tumble pattern of the laundry was altered, that cool water was added to the treating chamber 18, that a rinse or a spin phase was added or repeated, etc.

Figure 4:
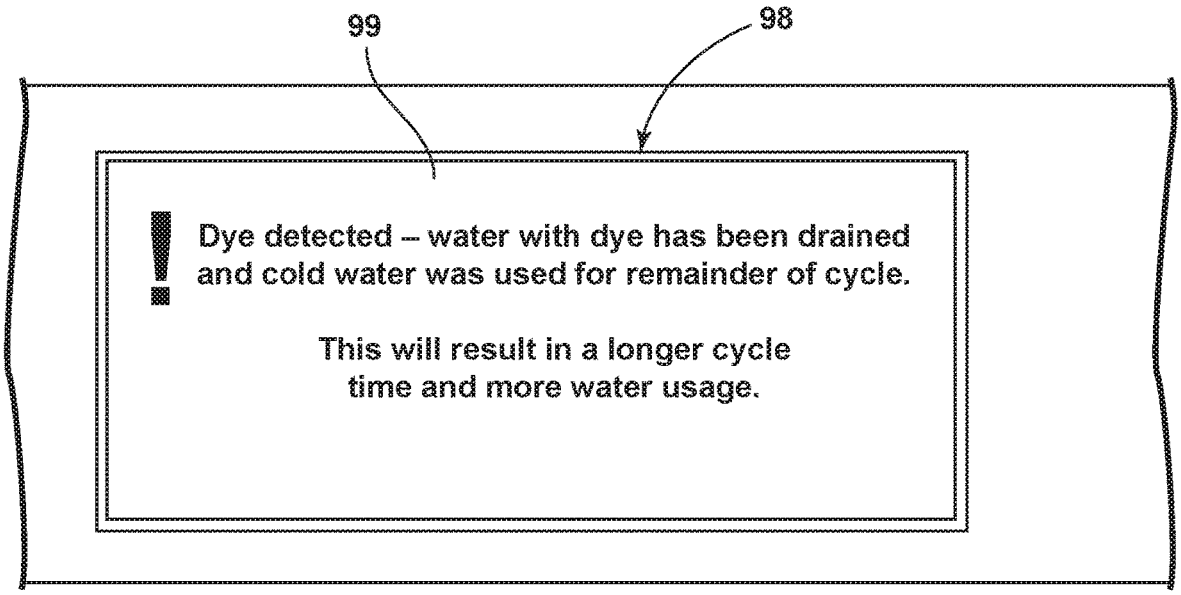
FIG. 4 illustrates a front view of a portion of the user interface of the washing machine of FIG. 1.

The actions taken by the washing machine 10 may cause a variety of consequences. For example, if the rinse phase may be repeated not only will the cycle of operation utilize more water than usual it will also be a longer cycle. The indicating at 204 may thus also include providing the user information indicating consequences of actions taken by the washing machine 10. For example, the information may include that the cycle used more water that the cycle was less energy efficient, that the cycle time will be longer, that there was reduced performance during the cycle of operation, etc. For example, FIG. 4 illustrates one example of information regarding at least one action taken by the laundry treating appliance in response to the determined dye release and information regarding at least one consequence of the at least one action taken by the laundry treating appliance. More specifically, the display 99 indicates that dye was detected and that water with the dye was drained by the washing machine 10 and cold water was used for remainder of cycle. The user interface 98 also conveys that such actions resulted in a longer cycle time and more water usage.

Figure 5A:
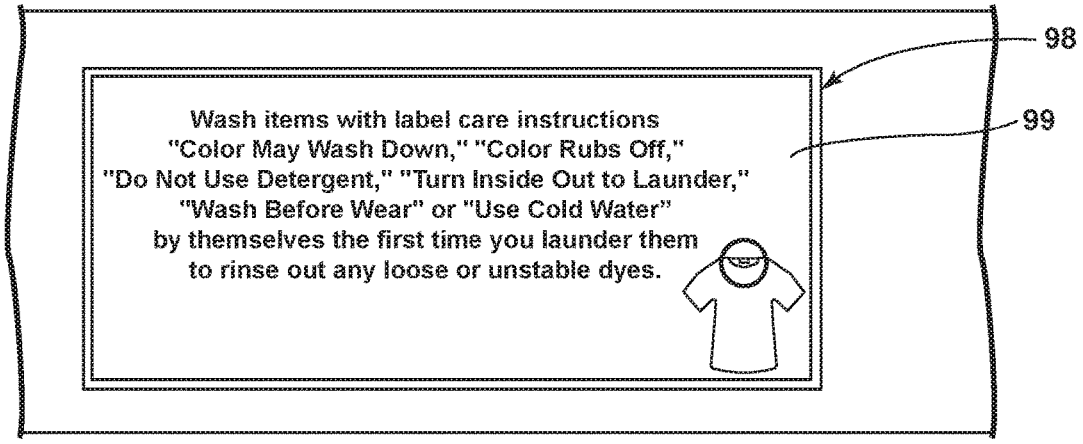
FIGS. 5A-5C illustrate alternative front views of a portion of the user interface of the washing machine of FIG. 1.
Figure 5B:
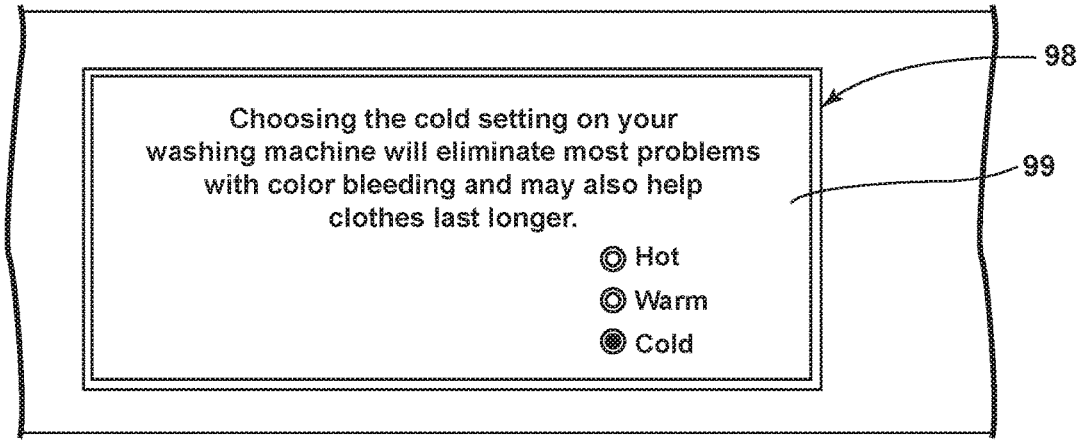
Figure 5C:
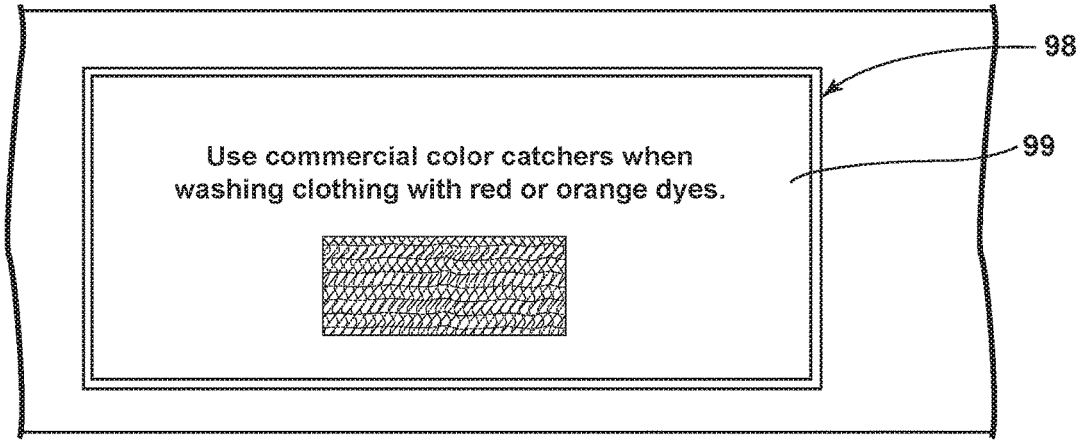

At 204, the indicating may also include indicating on the user interface 98 educational information to prevent future dye release events. This may include a variety of useful information including information on proper laundry article separation, information related to treating clothing that may be prone to dye release, etc. For example, FIG. 5A illustrates one example of educational information the user interface 98 may display to prevent future dye releases. The display 99 conveys educational information that items with label care instructions "Color May Wash Down," "Color Rubs Off," "Do Not Use Detergent," "Turn Inside Out to Launder," "Wash Before Wear" or "Use Cold Water" should be washed by themselves the first time you launder them to rinse out any loose or unstable dyes. By way of further example, FIG. 5B illustrates the display 99 conveying educational information that informs a user that choosing the cold setting on your washing machine will eliminate most problems with color bleeding and may also help clothes last longer. Further still, FIG. 5C illustrates the display 99 conveying educational information that using commercial color catchers when washing clothing with red or orange dyes may aid in preventing dye transfers.

It will be understood that the method of operating the laundry treating appliance may be flexible and that the method 200 illustrated is merely for illustrative purposes. For example, it is contemplated that it may also be indicating on the user interface 98 that the released dye has been determined. Further, a user may be alerted in other manners using other communication devices including that a text message may be sent to the user, an electronic mail may be sent to the user, or audio information may be provided to the user to relay various information regarding the determined released dye. It has been contemplated that an audible noise may be combined with any indications on the user interface 98 to additionally alert the user that the dye release has been determined or to alert the user to the additional information.

The above described embodiments provided a variety of benefits including that the user interface may indicate useful information when a dye release has been determined. The above described embodiments may also alter the cycle including that the cycle could be stopped to interrupt the bleeding process in an early stage to protect the other items from being dyed, and a rinse and spin phase could be included to decrease the dying effect. The laundry treating appliance may then communicate to the user what happened, what was detected, how the laundry treating appliance saved the load from a color transfer, how to prevent this scenario in the future, etc. This may result in increased user satisfaction as the information may indicate that the load of laundry has been saved from dye transfer damage and educate the user on preventing similar situations.

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. Further, while the above described embodiments have been described with respect to clothes washing machines the embodiments of the invention may be implemented in any suitable laundry treating appliance.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a laundry treating appliance having a treating chamber for receiving laundry for treatment according to an automatic cycle of operation implemented by a controller of the laundry treating appliance and having a user interface for communication with a user of the appliance, the method comprising:

determining a dye has been released from the laundry within the treating chamber to define a determined dye release; and indicating, on the user interface, information related to the determined dye release, where the information is separate from an alert that the released dye has been determined, and where the information comprises educational information to prevent future dye release or information regarding at least one consequence of at least one action taken by the laundry treating appliance including at least one of: that the treating cycle of operation used more water, that the treating cycle of operation was less energy efficient, that the treating cycle of operation time will be longer, or that there was reduced performance during the treating cycle of operation.

2. The method of claim 1 wherein the determining the dye release comprises sensing a released dye within the treating chamber.

3. The method of claim 2 wherein the sensing the released dye comprises sensing released dye in liquid from the treating chamber.

4. The method of claim 2 wherein the sensing the released dye comprises sensing an amount of dye color in liquid within the treating chamber.

5. The method of claim 4, further comprising determining a dye release event when the amount of sensed dye color satisfies a threshold.

6. The method of claim 5 wherein the indicating information on the user interface further comprises indicating on the user interface when a dye release event has been determined.

7. The method of claim 1, further comprising taking the at least one action to alter the cycle of operation to reduce an amount of dye color in treating liquid.

8. The method of claim 7 wherein the at least one action comprises draining of treating liquid from the treating chamber, stopping of the cycle of operation, altering of a tumble pattern, adding of cool water to the treating chamber, or adding a rinse or a spin phase.

9. The method of claim 1 wherein the educational information to prevent future dye release events comprises indicating information on proper laundry article separation.

10. The method of claim 1, further comprising alerting a user in a manner including sending a text message to the user, sending an electronic mail to the user, or providing audio information to the user.

11. The method of claim 1, further comprising indicating on the user interface that the released dye has been determined.

12. A method of operating a laundry treating appliance, the method comprising:

sensing a dye has been released from laundry within a treating chamber by sensing a released dye in liquid in the treating chamber or liquid from the treating chamber during a cycle of operation; and indicating, on a user interface, information related to the released dye based on the sensing, where the information is separate from an alert that the released dye has been determined, and where the information comprises at least one consequence of at least one action taken by the laundry treating appliance including at least one of: that the treating cycle of operation used more water, that the treating cycle of operation was less energy efficient, that the treating cycle of operation time will be longer, that there was reduced performance during the treating cycle of operation, or educational information to prevent future dye releases including at least one of: information on proper laundry article separation, information related to label care information, color catcher information, or information on selection of a cycle parameter to reduce dye release.

13. The method of claim 12, further comprising determining a dye release event when an amount of sensed dye color satisfies a threshold.

14. The method of claim 13, further comprising indicating on the user interface that the released dye has been determined.

15. The method of claim 14, further comprising taking the at least one action to alter the cycle of operation to reduce an amount of dye color in treating liquid.

16. The method of claim 15 wherein the at least one action comprises draining of treating liquid from the treating chamber, stopping of the cycle of operation, altering of a tumble pattern, adding of cool water to the treating chamber, or adding a rinse or a spin phase.

17. The method of claim 12, further comprising alerting a user in a manner including sending a text message to the user, sending an electronic mail to the user, or providing audio information to the user.

18. The method of claim 12, further comprising indicating on the user interface that the released dye has been determined.

19. A method of operating a laundry treating appliance having a treating chamber for receiving laundry for treatment according to an automatic cycle of operation implemented by a controller of the laundry treating appliance and having a user interface for communication with a user of the appliance, the method comprising:

sensing, via a sensor, an amount of dye release;

comparing the amount of dye release to a predetermined amount threshold;

determining, via the controller, based on the comparing that a dye has been released from the laundry within the treating chamber to define a determined dye condition; and indicating, on the user interface, information related to the dye release based on the determined dye condition, where the information is separate from an alert that the released dye has been determined, and where the information comprises educational information to prevent future dye releases including at least one of: information on proper laundry article separation, information related to label care information, color catcher information, or information on selection of a cycle parameter to reduce dye release.

20. The method of claim 19, further comprising indicating on the user interface that the released dye has been determined.

* * * * *